US007204046B2

(12) United States Patent
Currey

(10) Patent No.: US 7,204,046 B2
(45) **Date of Patent: *Apr. 17, 2007**

(54) EXCAVATOR SIZING BUCKET

(76) Inventor: Albert Ben Currey, 46631 N. 11th Ave., Phoenix, AZ (US) 85087-7129

( * ) Notice: Subject to any disclaimer, the term of this patent is extended or adjusted under 35 U.S.C. 154(b) by 121 days.

This patent is subject to a terminal disclaimer.

(21) Appl. No.: 11/006,234

(22) Filed: Dec. 6, 2004

(65) Prior Publication Data

US 2005/0126057 A1 Jun. 16, 2005

(51) Int. Cl.
*E02F 5/22* (2006.01)

(52) U.S. Cl. ..... 37/142.5; 37/379

(58) Field of Classification Search ..... 37/142.5, 37/379, 303, 403, 347, 188, 444, 445, 903, 37/418, 419; 414/722, 725; 209/418–421, 209/245, 248, 249, 260, 405

See application file for complete search history.

(56) References Cited

U.S. PATENT DOCUMENTS

| | | | |
|---|---|---|---|
| 645,864 | A | 3/1900 | Lyon |
| 2,142,794 | A | 1/1939 | Matthews |
| 2,402,299 | A | 6/1946 | Schield |
| 3,003,265 | A | 10/1961 | Lutjens |
| 3,072,257 | A | 1/1963 | Hockenberry |
| 3,273,730 | A | 9/1966 | Moore |
| 3,732,980 | A | 5/1973 | Evers et al. |
| 3,765,490 | A | 10/1973 | Logue |
| 3,904,052 | A | 9/1975 | Nordstrom |
| 4,157,956 | A | 6/1979 | Robinson |
| 4,303,507 | A | 12/1981 | Smith |
| 4,698,150 | A | 10/1987 | Wigoda |
| 4,890,400 | A | 1/1990 | Long |
| 5,160,034 | A | 11/1992 | Potter |
| 5,398,430 | A * | 3/1995 | Scott et al. ..... 37/142.5 |
| 5,405,092 | A | 4/1995 | Jonninen |
| 5,493,796 | A | 2/1996 | Ballew et al. |
| 5,528,844 | A | 6/1996 | Ellis |
| 5,581,916 | A | 12/1996 | Hirose et al. |
| 5,596,821 | A | 1/1997 | Solo et al. |
| 5,743,030 | A | 4/1998 | Sirr |
| 5,771,612 | A | 6/1998 | Lynch |
| 5,938,398 | A | 8/1999 | Brown |
| 5,940,996 | A | 8/1999 | Cummings |
| 6,059,119 | A | 5/2000 | Davis |
| 6,108,945 | A | 8/2000 | Cronk, Jr. |
| 6,237,257 | B1 | 5/2001 | Cronk, Jr. |

(Continued)

*Primary Examiner*—Thomas A Beach
(74) *Attorney, Agent, or Firm*—Schmeiser, Olsen & Watts LLP

(57) ABSTRACT

A sizing bucket for use in excavation and particularly trench padding. Embodiments of the invention include an angled sizing member extending between a base plate and a back plate of the sizing bucket. An aperture extends through the base plate beneath the sizing member. The bucket further includes an extended scoop portion to assist in transporting material to be sized and a pre-sized material portion behind the sizing member for transporting pre-sized material. A particular embodiment of the invention includes a sizing member with graded mesh sizes. The sizing bucket of embodiments of the invention allow an excavator operator to lower and tie-in pipe in a trench, transport material to the trench, size the material, pad the trench, backfill the trench and clean-up the area around the trench without the need to change buckets or excavating equipment.

20 Claims, 6 Drawing Sheets

U.S. PATENT DOCUMENTS 6,301,809 B1 10/2001 Staggs, Jr.
6,375,012 B1 * 4/2002 Leyland et al. ..... 209/421
6,439,393 B1 8/2002 Zeller

* cited by examiner

EXCAVATOR SIZING BUCKET

BACKGROUND OF THE INVENTION

1. Technical Field

This invention generally relates to attachments for excavation and construction equipment and particularly to a sizing bucket for an excavator for use in tieing-in pipe, dirt transport, padding, backfill and clean-up requirements.

2. Background Art

When excavating, and particularly when laying and burying pipe or other conduit (collectively "pipe"), building specifications and codes often include particular requirements relating to the size of the fill material used. Early methods of sizing fill material involved screening dirt over a stationary screen or purchasing pre-sized material. These methods, however, were often cumbersome and expensive. In response to the requirements for specific fill material sizes used for the stages of excavation and construction, various equipment has been developed in the industry to increase the efficiency with which fill material is sized and placed.

Many recent excavation sizing equipment designs, however, involve the use of sizing buckets which include additional powered or mechanically operated equipment to size and place the material. The additional equipment was primarily implemented to avoid clogging of a screen by large materials (i.e. use of a vibrator), or to allow the material to be transported between different locations without falling through the screen (i.e. screen cover). One particular example of an excavator bucket with a screen cover may be found in U.S. Pat. No. 5,743,030 to Sirr (issued Apr. 28, 1998). In this reference, for example, a separately operable cover is placed over the bottom of a bucket which has a screen in its bottom surface. Dirt is scooped into the bucket, the dirt is transported to an appropriate location, and the separate cover is removed from the bottom of the bucket to allow the fill material to fall through the screen. The larger materials, or "bones", are then placed in a discard pile. Additional powered equipment, however, requires additional hook-ups and causes the bucket to be more difficult to operate, more difficult to connect to the excavator, and more likely to have failure due to the moving parts. Vibrators, such as that shown in U.S. Pat. No. 5,493,796 to Ballew et al. (issued Feb. 27, 1996), are also subject to mechanical or power failure. Without the agitation of the dirt over the screen, the larger materials may prevent the smaller materials from falling through. Additionally, through agitation of the bucket by shaking it back and forth, rather than or in addition to using a separately powered agitator, many excavator operators have found that much of the fill material falls around rather than on or in the desired location.

Another aspect of excavation which currently causes inefficiency and added expense, is the requirement that different excavation equipment be used for various stages of the same excavation project. While laying pipe, for example, a pipe is lowered into a trench by an appropriate excavator with a lowering eye. Next, fill material is either sized through a padding machine or pre-sized and transported to the trench by another excavation machine. The trench is then back-filled by an appropriate front-end loader or the like to meet building specifications and codes, or otherwise filled with a differently-sized fill material. The ground is then "cleaned-up." In excavation, cleaning-up an area of a filled trench may involve such actions as raking the area for dirt and debris, grading and/or sculpting the land, creating roadways, and the like. For each stage of an excavation process, different excavators or attachments for excavators are used. This increases the cost for the project, increases the equipment necessary to complete the job, and extends the time required to complete the job.

DISCLOSURE OF THE INVENTION

The present invention relates to a bucket for an excavator which is configured to not only place pipe, transport dirt and clean-up a filled trench, but also to size the materials for padding and backfilling the trench. As used herein, the term "excavator" is intended to include equipment used in excavating and includes, but is not limited to, bulldozers, loaders, backhoes, and other excavation equipment configured to accept a bucket or other two- or more-pinned attachments.

The sizing bucket of particular embodiments of the present invention includes a sizing member extending from the base plate of the bucket to the back plate of the bucket such that a pre-sized material area exists between the sizing member and an aperture in the back plate of the bucket. The sizing member is angled with respect to the base plate at an angle greater than 20°, more particularly between approximately 30°–60°, and most specifically between approximately 35°–45°. The base plate includes an elongated scoop portion in front of the sizing member and a pre-sized material portion between the sizing member and the aperture in the back plate. The pre-sized material portion allows an excavator operator to carry pre-sized material to a trench and to more accurately place the material within the trench. Particular embodiments of the sizing member include either a consistent mesh size or a graded mesh size to allow more material to be sized without larger materials blocking the sizing member openings.

Methods of excavating include lowering a pipe into a trench, transporting material to the trench, sizing the material, padding the trench, backfilling the trench and cleaning-up around the trench area all with the same excavator and bucket. By using only a single excavator to accomplish so much of the excavation process, a significant amount of time is saved and excavation costs are lowered.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
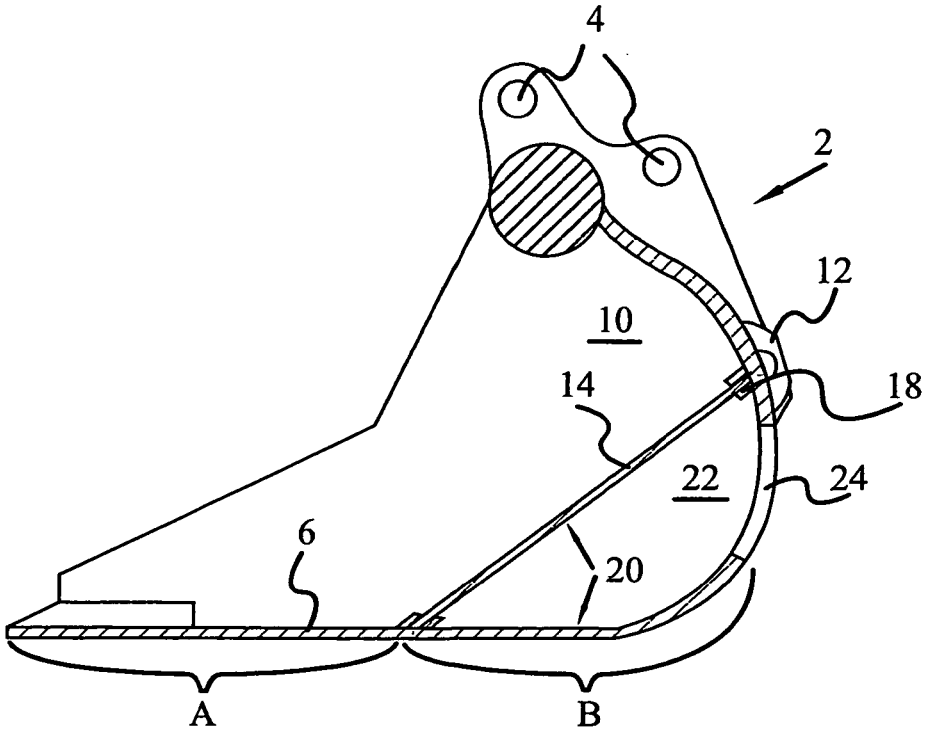
FIG. 1 is a side section view of an excavator bucket configured according to an embodiment of the present invention.
Figure 2:
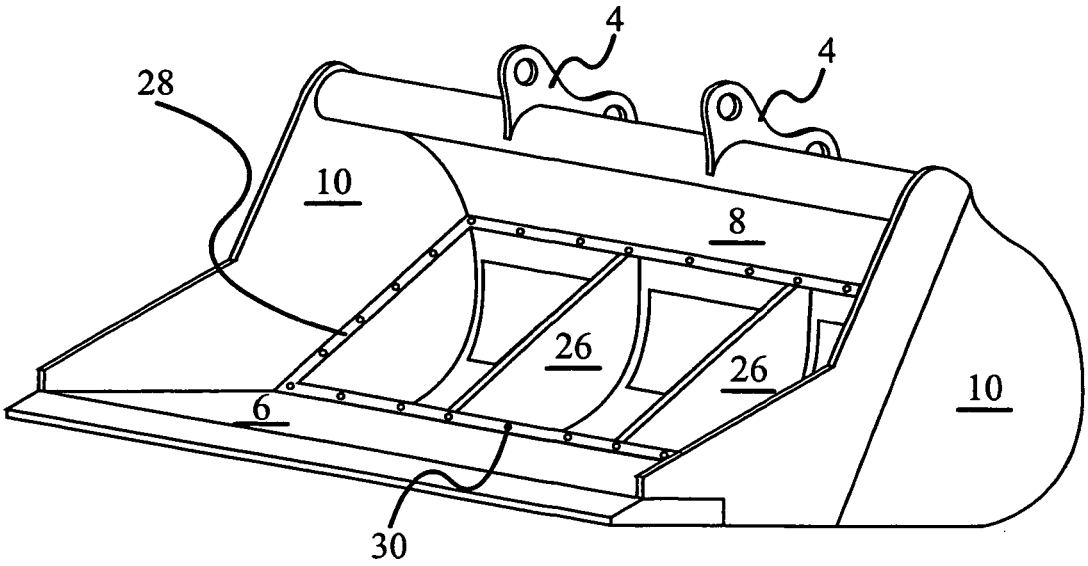
FIG. 2 is a perspective view of the excavator bucket shown in FIG. 1.
Figure 3A:
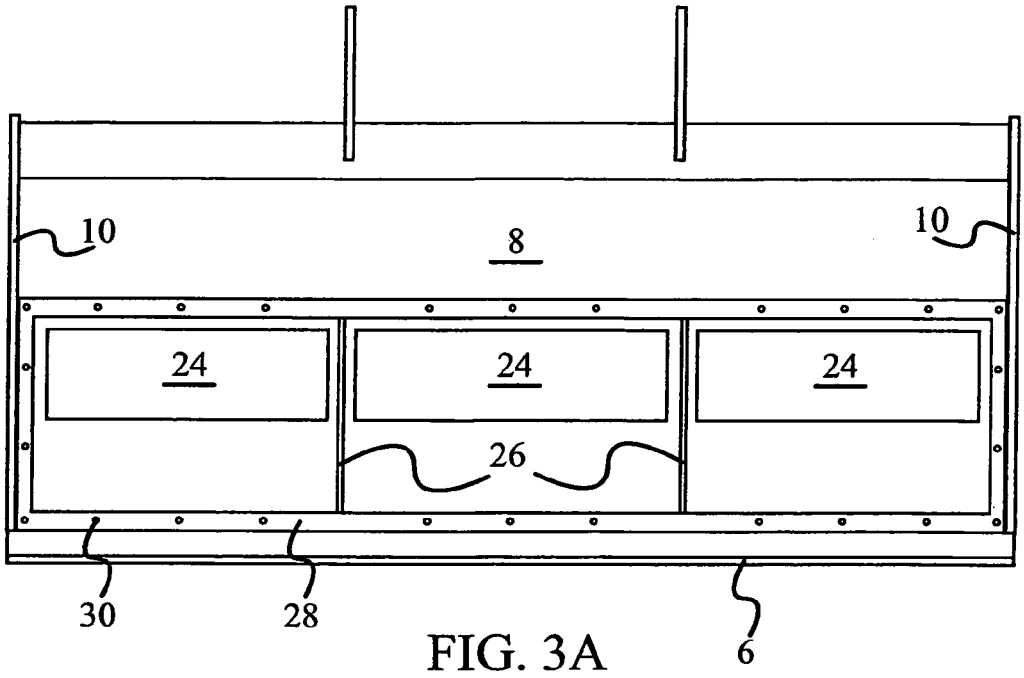
FIG. 3A is a view of the front of the excavator bucket shown in FIG. 1 with the sizing member removed.
Figure 3B:
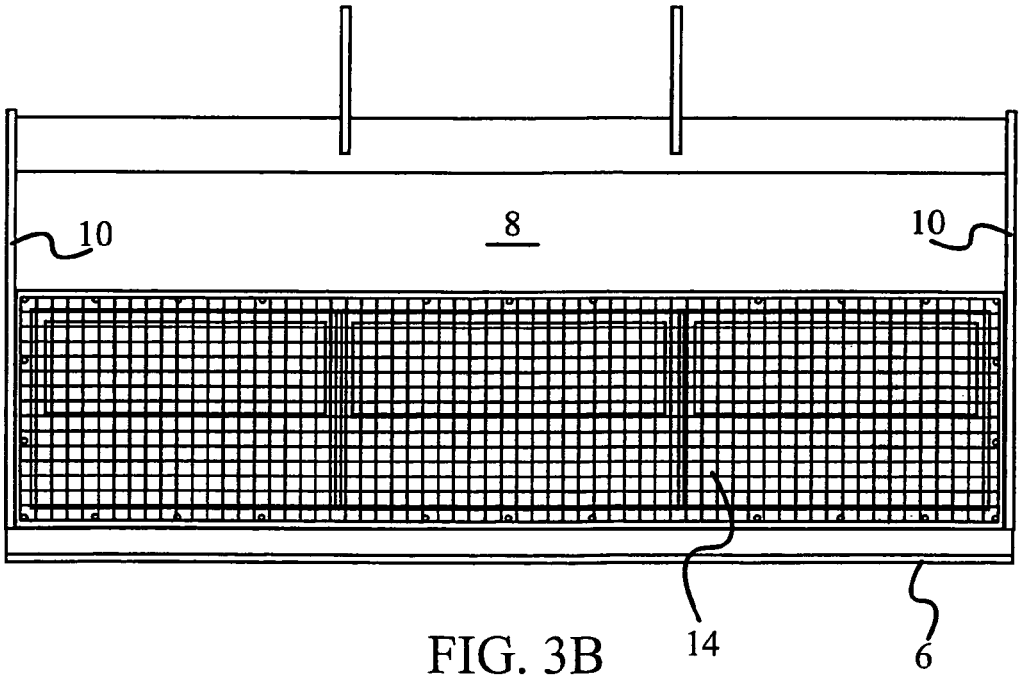
FIG. 3B is a perspective view of the front of the excavator bucket shown in FIG. 1 with the sizing member in place.

As discussed above, embodiments of the present invention relate to an excavator having a sizing bucket which not only sizes fill material, but also transports material, back-fills a trench and cleans-up the filled trench. FIGS. 1–3 illustrate views of a sizing bucket 2 configured according to an embodiment of the present invention. Like a conventional excavator bucket, the sizing bucket 2 of the present invention includes two sets of pin holes 4, a base plate 6, a back plate 8 and side plates 10. While the base plate 6 and the back plate 8 may be formed of a single sheet of material or of separate sheets or materials welded together and are therefore integral to each other, they are recited separately herein for purposes of structural explanation only. For convention and clarity in explanation it will be assumed that the base plate 6 ends and the back plate begins where the apertures 24 begin so that the apertures 24 are through the back plate 8. Some conventional buckets also include a lowering eye 12.

In addition to the features of a conventional bucket, however, the bucket 2 of the present invention includes a sizing member 14, such as a screen, which extends from a first location 16 on the base plate 6 to a second location 18 on the back plate 8 such that the sizing member 14 is at an angle 20 in relation to the base plate 6. By placing the sizing member 14 at an angle 20 in relation to the base plate 6, a volume 22 is created within the bucket 2 between the sizing member 14 and one or more apertures 24 through the back plate 8 of the bucket 2. The apertures 24 allow sized material to exit the bucket in a controlled manner. As shown best in FIGS. 2 and 3A, where the sizing member 14 has been removed, center support ridges 26 and side supports 28 provide support and tie-downs 30 for the sizing member 14 within the bucket 2. Tie-downs 30 may be of any form known in the art for coupling a sizing member 14 to a bucket including, but not limited to, bolts and nuts, permanent or temporary welds, wire ties, clamps and the like which serve the purpose of holding the sizing member 14 in the bucket 2 during operation. Additionally, a support bracket may be provided over and around the perimeter of the sizing member 14 and coupled to the side supports 28 to press the perimeter of the sizing member 14 against the side supports 28 to assist in holding the sizing member 14 in the bucket 2.

The scoop portion A of the base plate 6 of the embodiment shown in FIGS. 1–3 is elongated compared to that of a conventional bucket to provide a greater region for transporting material to be sized. The center support ridges 26 also serve to reinforce the bucket to support the added stress from the extended base plate 6. The pre-sized material transport portion B of the base plate 6, which is the region from the first location 16 to the point where the apertures 24 begin, allows a portion of the material to be sized to pass through the sizing member 14 during scooping or transport. In this way, pre-sized material can immediately pass through the apertures 24 when an operator tips the bucket 2 upward to cause more of the sized material to pass through the apertures 24 to the desired location. The operation of the bucket 2 will be further described in reference to FIGS. 5–10.

Figure 4A:
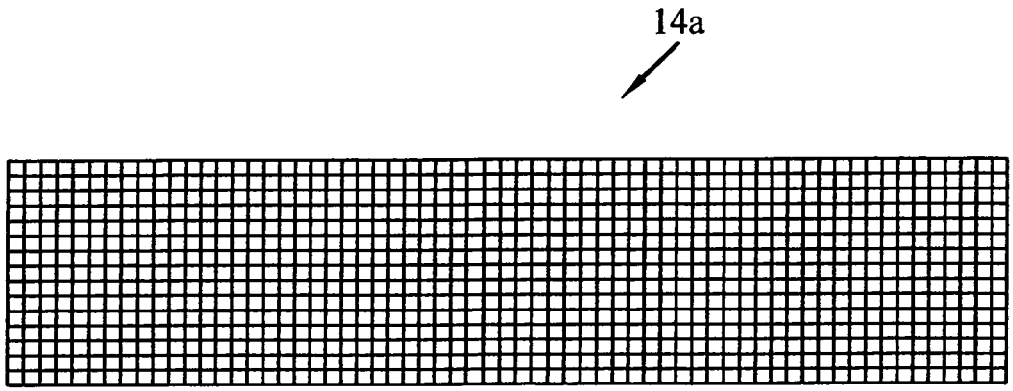
FIG. 4A is a view of a first sizing member embodiment having a consistent mesh size.

FIG. 4A is a first embodiment of a sizing member 14*a* having a consistent mesh size throughout. The mesh size of a sizing member 14*a* determines what size of materials will pass through the sizing member. The particular mesh size for a specific stage of an excavation project depends upon the excavation project and may readily be determined by one of ordinary skill in the art. For example, for padding a pipe, one conventional code requirement for mesh size uses 1" mesh spacings. However, all mesh sizes are contemplated as useful with this invention so long as the mesh size is smaller than the dimension of the aperture 24. Formation of sizing members, such as screens, wire cloth and wire mesh, are well known in the art. Conventional methods of forming sizing members, while well known, may include such methods as weaving and/or welding wire in a mesh, creating a tensioned wire mesh across a frame, and cutting apertures in a plate. Sizing members for embodiments of the invention described herein may be obtained from a number of sizing member manufactures including Diamond Casting of Mesa, Ariz. and Huflin Steel of Phoenix, Ariz.

Figure 4B:
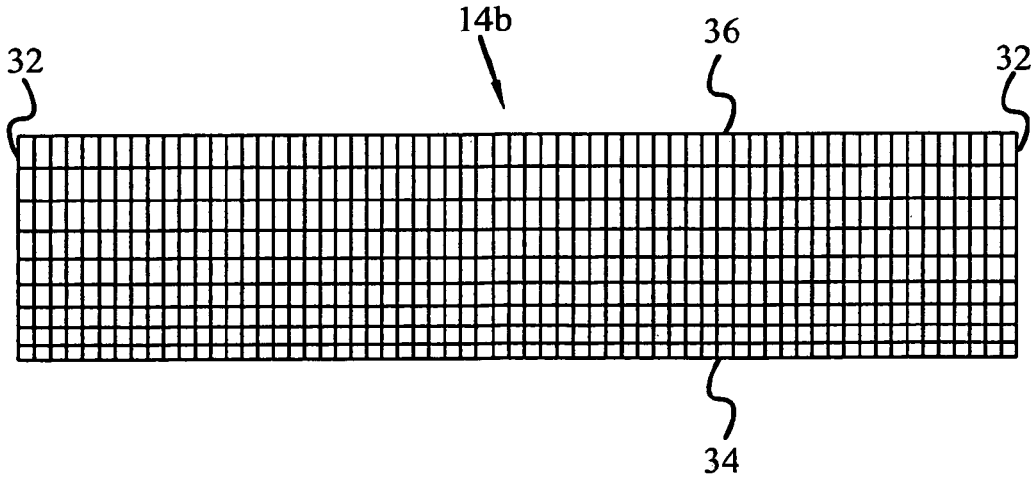
FIG. 4B is a view of a second sizing member embodiment having a graded mesh size.

FIG. 4B is a second embodiment of a sizing member 14*b* having a graded mesh size. The graded mesh size sizing member 14*b* includes relatively small mesh openings 32 near a first edge 34 of the sizing member 14*b* which graduate to relatively larger mesh openings 32 near a second edge 36 of the sizing member 14*b*. One specific benefit of a graded mesh size sizing member 14*b* is that when the sizing member 14*b* is used in an excavator bucket 2, such as that shown in FIGS. 1–3, with the first edge 34 near the base plate 6 and the second edge near the back plate 8, the likelihood of clogging the sizing member is reduced. Due to the clearance below the sizing member near the base plate, only smaller sized materials are able to pass through the sizing member. The clearance below the sizing member increases toward the back plate. Accordingly, use of a smaller mesh size near the base plate, graduating to a larger mesh size near the back plate allows only material with sufficient clearance to pass through the sizing member at each point along the bucket. This reduces the likelihood that larger materials will block the first openings due to inadequate clearance.

It will be understood by those of ordinary skill in the art that the sizing member 14 of the present invention may be a simple screen having no moving parts. Without moving parts, there is less likelihood of mechanical failure of the bucket during operation. It will also be understood by those of ordinary skill in the art that in select configurations, the sizing member 14 may be adapted to include a vibrator or be configured as a crusher to crush larger material to be sized to an appropriate size. The volume 22 between the sizing member 14 and the aperture 24 is, therefore, advantageous to reduce sizing member blockage in both powered and unpowered sizing member applications. More complex embodiments with moving parts, however, are also more likely to suffer mechanical failure and are more difficult to attach to an excavator where power or hydraulics from the excavator are necessary to operate the moving parts.

Excavator bucket manufacturers of ordinary skill in the art are familiar with the principles of bucket manufacture and the structural integrity necessary for building buckets according to embodiments of the invention. Side supports 28 around the perimeter of the sizing member may be formed of ⅝"×3" flat bar with threaded bolts spaced at 8" intervals. A support bracket for bolting to the side bolts over the sizing member 14 may be formed of ½"×2" flat bar with openings cut therethrough at 8" spacings to accept the threaded bolts of the side supports 28. The sizing member 14, configured to size approximately 4" material, includes a screen having an approximately 40" depth extending from the base plate 6 to the back plate 8 with mesh sizes ranging from approximately 2" at the edge nearest the base plate 6 to approximately 4" at the edge nearest the back plate 8. In another specific embodiment of the sizing member, an approximately 1" mesh is created using approximately 5/16" diameter wire. It should be noted that the larger the diameter of wire used for a sizing member configured as a screen, the smaller the total sizing area available for sized material to pass through. Thus, it is desirable to use smaller diameter wire. However, smaller diameter wire is generally not as strong as larger diameter wire. Accordingly, various methods known in the art, such as heat treating the wire, may be used to obtain minimal size with maximum tensile strength. One of ordinary skill in the art will readily be able to determine an appropriate mesh size, wire diameter and tensile strength given information regarding the desired application for the sizing member.

In particular embodiments of the invention, the sizing member is placed at an angle 20 from the base plate 6 of greater than approximately 20°. The angle 20 between the base plate 6 and the sizing member should be placed such that sufficient clearance is found between the sizing member and the aperture 24 to allow the material to fall freely through the sizing member and allow the material to be sized to shift over the top of the sizing member when the bucket 2 is tilted back and then forward. This range is more typically between approximately 30° and approximately 60° to allow the material to be sized to roll adequately on the sizing member through conventional movement of the bucket.

For the specific embodiment shown in FIGS. 1–3, the scoop portion A of the bucket is configured to have a depth approximately the same as the depth of the sizing member (approx. 40"), the pre-sized material transport portion B is at least 75% of the depth of the sizing member, and the depth of the apertures 24 is approximately 50% of the depth of the pre-sized material transport portion B. Thus, the sizing member area is at least twice as large as the area of the apertures 24, and more particularly at least three times as large as the area of the apertures 24. As used herein, "depth" refers to the distance between the front of the member or aperture to the back of the member or aperture as opposed to its width, and does not refer to the thickness of the member or aperture. Use of an elongated 15" deep aperture allows sizing of material up to size 12" minus. The specific sizes illustrated for the specific embodiment herein are exemplary only and represent only one particular embodiment of the invention for a specific purpose and excavator size range. The dimensions, ratios of dimensions and mesh and aperture sizes will necessarily be modified for each particular application of the invention and for use with other-sized excavators and buckets. Given the explanations herein, one of ordinary skill in the art will be able to make these adjustments to apply the principles of the invention to other-sized applications.

It is also contemplated that a conventional excavator bucket may be converted into a sizing bucket configured according to an embodiment of the invention by cutting apertures in the back plate of the bucket and installing a sizing member between the base plate and back plate of the bucket. An additional, extended scoop portion may be obtained by coupling an extension to the conventional bucket and adding structural reinforcement to the bucket.

Figure 5:
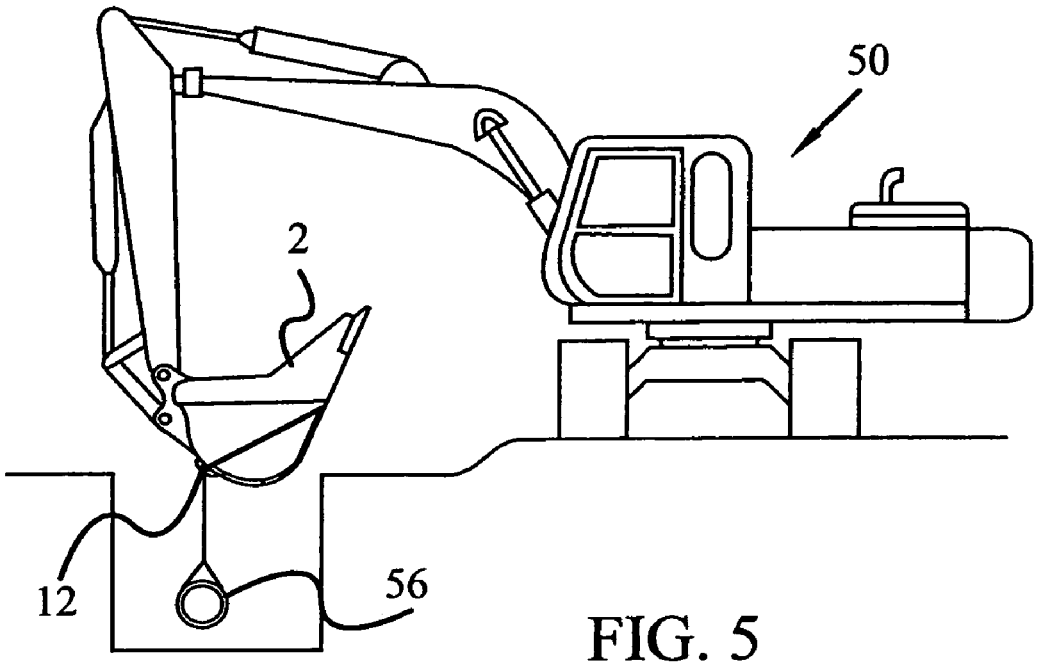
FIG. 5 is an elevational view partly in section illustrating the excavator and bucket in operation to lower a pipe into a trench.

FIGS. 5–10 illustrate use of an excavator bucket 2 configured according to an embodiment of the present invention for use with an excavator. The ground and the bucket 2 are shown in partial sectional view to illustrate the trench and pipe 56, as well as the position of the material to be sized 52 and the pre-sized material 54 in relation to the bucket 2 and the sizing member 14 within the bucket 2. In FIG. 5, the bucket 2 is being used to lower a pipe 56 into a trench to tie the pipe 56 to other pipes within the trench using a lowering eye 12.

Figure 6:
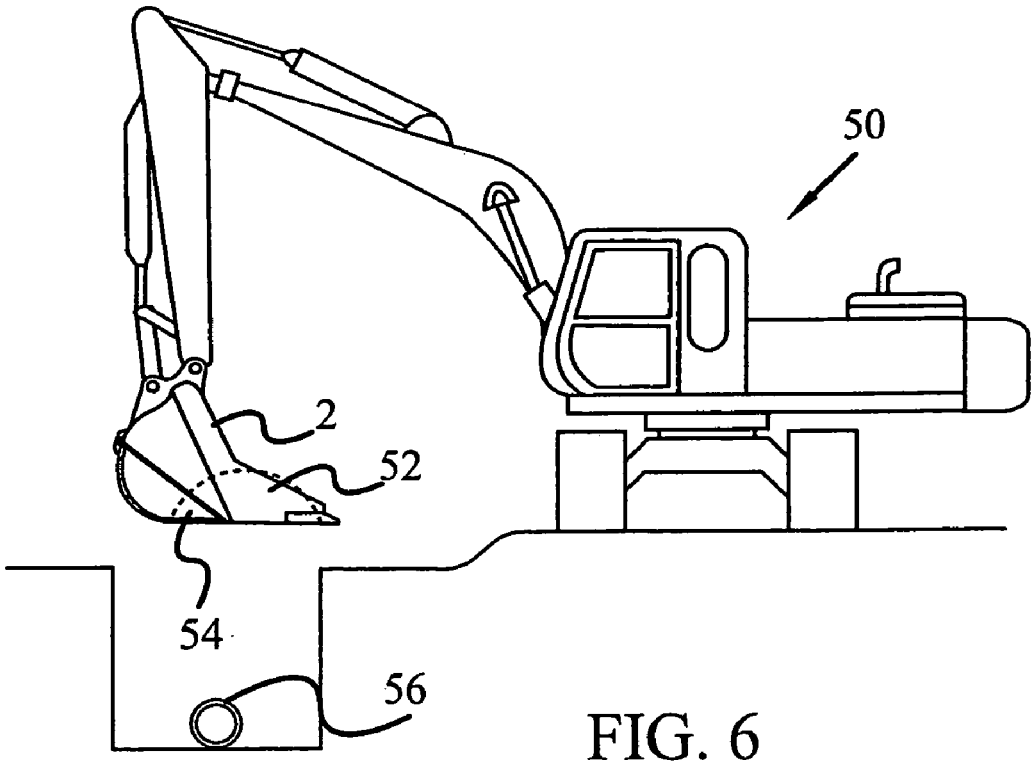
FIG. 6 is an elevational view partly in section illustrating the excavator and bucket in operation with dirt scooped into the bucket.

Once the pipe 56 is tied-in to the pipe system, the excavator 50 may pad the pipe using appropriately sized fill material. As shown in FIG. 6, when the excavator 50 scoops a load of material to be sized into the bucket 2, a portion 54 of the material is pre-sized. The material, therefore, is transported on the scoop portion of the bucket as well as the pre-sized material transport portion (see FIG. 1). Unlike a conventional padding bucket, because the sizing bucket of the present invention includes an elongated scoop portion and a pre-sized material transport portion, the material to be sized may be readily transported by the excavator from one site to another without losing any significant portion of the material. Conventional sizing buckets require a powered attachment to accomplish this function.

Figure 7:
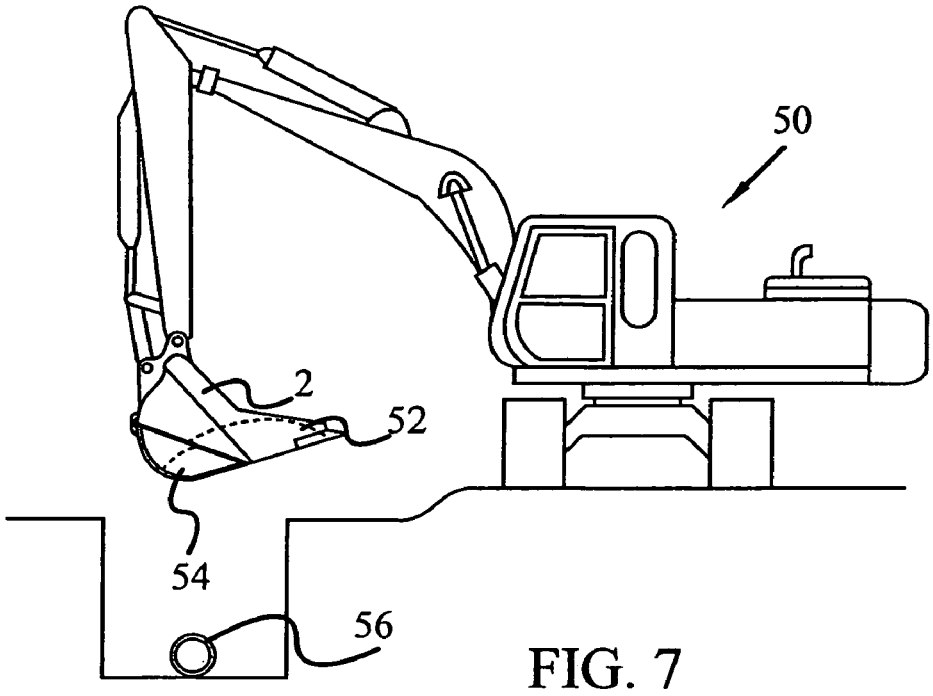
FIG. 7 is an elevational view partly in section illustrating the excavator and bucket in operation to shift the dirt across the sizing member.
Figure 8:
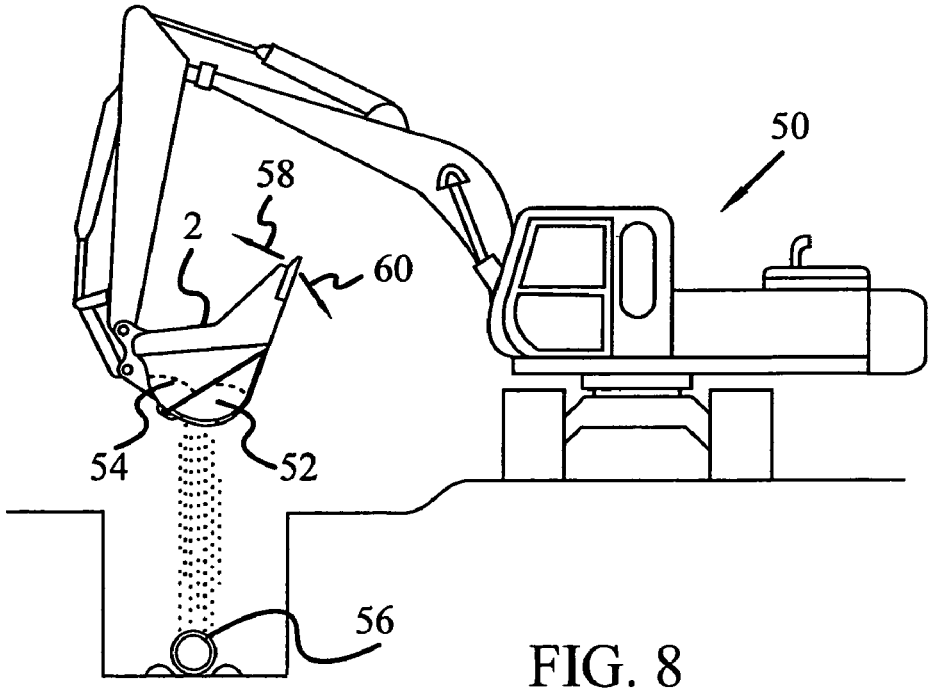
FIG. 8 is an elevational view partly in section illustrating the excavator and bucket in operation while cleaning the screen and sizing more dirt.

When the operator of the excavator 50 has placed the bucket 2 above the trench to be padded, the operator may then begin to tip the bucket upward (e.g. raise the scoop portion up). As shown in FIG. 7, this causes the material to be sized 52 to shift further back on the sizing member. If tipped far enough, this also causes the material too large to pass through the sizing member ("bones") to shift near the top of the sizing member or onto the back of the bucket to clear the sizing member. For the purposes of this application, a sizing member is considered "cleared" if less than ⅓ of the sizing member has material on it from shifting the bones to the top or bottom of the sizing member. A cleared sizing member leaves sufficient open space on the sizing member for smaller material to fall through the sizing member. FIG. 8 illustrates the sized material falling through the opening in the bucket 2 and the bones shifted near the back of the bucket to clear the sizing member. The apertures in the bucket 2 are sized larger than the mesh size of the sizing member. This allows the sized material to easily fall through the apertures and into the trench. Another particular benefit of spacing the sizing member from the apertures in the bucket is that a larger area of sizing member may be used while still providing a smaller opening area for the material to fall from the bucket. Note that even at the point to which the bucket is tipped in FIG. 8, the bones have slid to the back of the bucket so that more than half of the sizing member includes no bones on it. The arrows near the tip of the bucket in FIG. 8 illustrate that the bucket may be tipped upward 58 or downward 60 from the position shown. By tipping the bucket further upward in the direction of arrow 58, the bones 54 will roll further toward the back plate of the bucket 2 so that almost all of the sizing member is free of bones. The precise area of the screen which is cleared will depend upon the quantity of bones in a particular dirt sample, the angle of the sizing member with respect to the base plate of the bucket and the degree to which the bucket may be tipped upward for a particular excavator.

It should be noted that tipping the bucket upward to clear the screen is tipping to a greater degree than just a shake of the bucket. The tipping involved with the present invention includes tipping past the point where the sizing member is level with the ground. While in some embodiments tipping only to an angle around or greater than approximately 15° with the horizontal may be necessary, it is contemplated that any larger angle may also be used. In particular embodiments, the bucket 2 is tipped upward such that the sizing member is at an angle of between approximately 30–70° with the horizontal.

After the bucket 2 is tipped upward in the direction of arrow 58 and the screen has been at least partially cleared, the bucket may then be tipped back down in the direction of arrow 60 to allow the bones to again pass over the surface of the cleared sizing member. By re-passing the bones over the sizing member, any material which may have been of a size to previously pass through the sizing member may pass through on the second pass. As with tipping upward, tipping downward in the direction of arrow 60 is also more than merely shaking the bucket and may involve tipping the bucket such that the sizing member is at an angle greater than approximately 15° with the horizontal, and in particular embodiments between approximately 30–70°. Additional cycles may be performed as necessary to completely size the material. The remaining bones are discarded and additional sizing may be performed.

One problem conventionally experienced by buckets with sizing members on a surface of the bucket is that the sizing member becomes blocked by material too large to pass through the sizing member. In such cases, the excavator operator must shake the bucket to dislodge the material blocking the sizing member openings. This often causes the sized material to miss its mark and be thrown outside the trench, and causes additional unnecessary wear on the excavator and operator. Where a smaller sizing member is placed on or near a surface of the bucket, the small sizing member becomes blocked too quickly which makes the process inefficient. A larger sizing member area spaced from the smaller opening allows more of the dirt to be screened and accurately placed without blocking the sizing member. For example, in embodiments of the invention, the sizing member area is greater than approximately twice the area of the apertures in the back plate of the bucket. In other embodiments, the sizing member area is greater than approximately three times the area of the apertures in the back plate of the bucket. It may take several bucket loads to fill a trench. With the sizing bucket of the present invention, the material to be sized may be directly adjacent the trench or at some other location remote from the trench.

Figure 9:
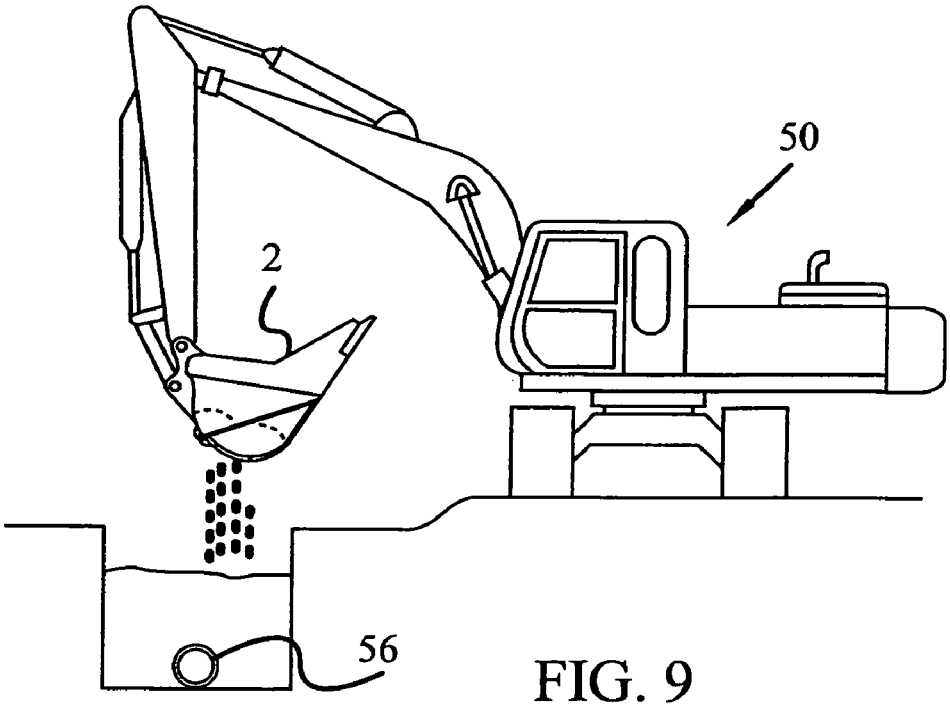
FIG. 9 is an elevational view partly in section illustrating the excavator and bucket in operation to back-fill the trench.
Figure 10:
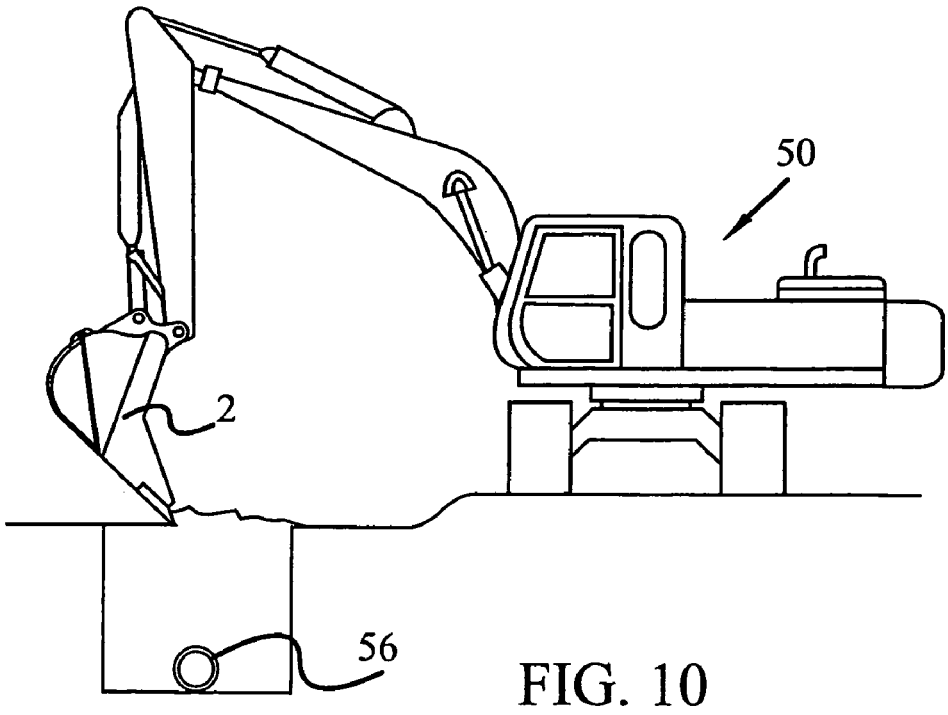
FIG. 10 is an elevational view partly in section illustrating the excavator and bucket in operation to clean-up the area around the trench.

Once the pipe 56 is properly padded with sufficient material, the trench may be backfilled with appropriately sized materials. Using a different mesh size, such as by replacing the sizing member or changing to a different bucket, larger materials may be moved into the trench with the same or similarly configured bucket 2. FIG. 9 illustrates backfilling the trench with larger materials. If the particular backfill requirements do not limit the size of the materials to be placed in the trench, or the material to be sized is already appropriate backfill size, the bucket may be used to directly move the backfill material into the trench without using the sizing member for sizing. FIG. 10 illustrates the excavator 50 cleaning-up the surface of the trench with the bucket using the tip of the bucket. The bottom of the bucket may also be used to clean-up around the trench.

Thus, it may be seen from the disclosure herein that the excavator bucket of embodiments of the present invention, in addition to being capable for use with some digging, allows an excavator operator to lower and tie-in pipe in a trench, pad the pipe, backfill the trench and clean-up around the surface of the trench using the same sizing bucket. This significantly saves time and money in the excavation process. Furthermore, with the angled sizing member, the pre-sized material portion and the volume between the sizing member and the aperture in the bucket, the material to be sized is more easily transported, sized and accurately placed within the trench.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A sizing bucket for an excavator, the sizing bucket comprising:

a base plate;

a back plate integral with the base plate;

a sizing member extending between a first location on the base plate and a second location on the back plate, the sizing member extending at an angle with respect to the base plate of between approximately 20° and approximately 60°; and at least one aperture through the back plate between the first and second locations;

wherein the base plate comprises a first portion for transporting materials to be sized on a first side of the sizing member.

2. The sizing bucket of claim 1, wherein the first portion of the base plate has a first portion depth and the sizing member has a sizing member depth approximately the same the first portion depth.

3. The sizing bucket of claim 2, wherein the first portion of the base plate is on a first side of the sizing member, the base plate comprising a second portion on a second side of the sizing member for transporting sized material, wherein the second portion of the base plate has a second portion depth equal to at least 75% of the sizing member depth.

4. The sizing bucket of claim 1, wherein the angle with respect to the base plate is between approximately 35° and approximately 45°.

5. The sizing bucket of claim 4, wherein the angle with respect to the base plate is approximately 40°.

6. The sizing bucket of claim 1, wherein the sizing member comprises at least a first mesh size located near the back plate and at least a second mesh size, smaller than the first mesh size, located near the base plate.

7. The sizing bucket of claim 1, wherein the sizing member comprises at least three different mesh sizes, a first mesh size located near the base plate, a second mesh size larger than the first mesh size located between the base plate and the back plate and a third mesh size larger than the second mesh size located near the back plate.

8. The sizing bucket of claim 1, wherein the base plate comprises a first portion on a first side of the sizing member for transporting materials to be sized and a second portion on a second side of the sizing member opposite the first side for transporting sized materials.

9. The sizing bucket of claim 8, wherein the sizing member has a sizing member depth and the second portion on the second side of the sizing member has a second portion depth equal to at least 75% of the sizing member depth.

10. The sizing bucket of claim 1, wherein the second portion of the base plate has an area greater than a total area of the at least one aperture.

11. The sizing bucket of claim 10, wherein the total area of all the apertures through the back plate has a combined area of less than one-third of the area of the sizing member.

12. The sizing bucket of claim 1, wherein the sizing bucket includes no moving parts.

13. A sizing bucket for an excavator, the sizing bucket comprising:

a base plate;

a back plate integral with the base plate;

a sizing member extending between a first location on the base plate and a second location on the back plate, the sizing member extending at an angle with respect to the base plate of greater than approximately 20°; and at least one aperture through the back plate between the first and second locations, the total area of all apertures through the back plate having a combined area of less than half of an area of the sizing member;

wherein the base plate comprises a first portion for transporting materials to be sized on a first side of the sizing member.

14. The sizing bucket of claim 13, wherein the first portion of the base plate has a first portion depth and the sizing member has a sizing member depth approximately the same as the first portion depth.

15. The sizing bucket of claim 14, wherein the first portion of the base plate is on a first side of the sizing member, the base plate comprising a second portion on a second side of the sizing member for transporting sized material, wherein the second portion of the base plate has a second portion depth equal to at least 75% of the sizing member depth.

16. The sizing bucket of claim 13, wherein the angle with respect to the base plate is between approximately 20° and approximately 60°.

17. The sizing bucket of claim 13, wherein the angle with respect to the base plate is between approximately 35E° and approximately 45°.

18. The sizing bucket of claim 13, wherein the sizing member comprises at least a first mesh size located near the back plate and at least a second mesh size, smaller than the first mesh size, located near the base plate.

19. The sizing bucket of claim 13, wherein the second portion of the base plate has an area greater than a total area of the at least one aperture.

20. The sizing bucket of claim 19, wherein the total area of all the apertures through the back plate has a combined area of less than one-third of the area of the sizing member.

* * * * *